US008764004B2

(12) United States Patent
Taniguchi

(10) Patent No.: US 8,764,004 B2
(45) Date of Patent: Jul. 1, 2014

(54) SHEET FEEDING DEVICE AND IMAGE FORMING APPARATUS INCLUDING THE SAME

(71) Applicant: Kyocera Document Solutions Inc., Osaka (JP)

(72) Inventor: Susumu Taniguchi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/657,985

(22) Filed: Oct. 23, 2012

(65) Prior Publication Data

US 2013/0119603 A1 May 16, 2013

(30) Foreign Application Priority Data

Nov. 11, 2011 (JP) ..... 2011-247083

(51) Int. Cl.
*B65H 3/44* (2006.01)

(52) U.S. Cl.
USPC ..... 271/9.09; 271/9.08; 271/9.07

(58) Field of Classification Search
USPC ..... 271/9.07, 9.08, 9.09, 9.11, 9.13
See application file for complete search history.

(56) References Cited

U.S. PATENT DOCUMENTS

| | | | | |
|---|---|---|---|---|
| 7,448,609 | B2 * | 11/2008 | Terashima et al. | 271/9.08 |
| 7,782,504 | B2 * | 8/2010 | Okubo et al. | 358/498 |
| 7,909,318 | B2 * | 3/2011 | Kim et al. | 271/9.13 |
| 8,517,370 | B2 * | 8/2013 | Shiohara et al. | 271/9.07 |
| 2002/0117797 | A1 | 8/2002 | Kawarama | |
| 2006/0163796 | A1 * | 7/2006 | Shiohara et al. | 271/9.01 |
| 2008/0309001 | A1 | 12/2008 | Muramatsu | |

FOREIGN PATENT DOCUMENTS

| | | | |
|---|---|---|---|
| JP | 002204229 | A | 8/1990 |
| JP | 035256941 | A | 11/1991 |
| JP | 05286593 | A | 11/1993 |
| JP | 08091613 | A | 4/1996 |
| JP | 2002249237 | A | 9/2002 |
| JP | 2008-162710 | | 7/2008 |
| JP | 2008308314 | A | 12/2008 |

* cited by examiner

*Primary Examiner* — Kaitlin Joerger
(74) *Attorney, Agent, or Firm* — Morgan, Lewis & Bockius LLP

(57) ABSTRACT

A sheet feeding device includes a sheet guide portion disposed upstream of a nip portion so as to guide a leading edge of a sheet sent from a sheet storing portion to the nip portion, and a manual bypass guide member which extends from a manual bypass sheet feeder and has a leading edge portion disposed between the sheet guide portion and the nip portion and can be elastically deformed in up and down direction so as to guide a manual bypass sheet to the nip portion. The manual bypass sheet is guided by the manual bypass guide member toward the nip portion and is sent out by the feed roller to a sheet transport path.

8 Claims, 5 Drawing Sheets

SHEET FEEDING DEVICE AND IMAGE FORMING APPARATUS INCLUDING THE SAME

INCORPORATION BY REFERENCE

This application is based on and claims the benefit of priority from Japanese Patent Application No. 2011-247083 filed on Nov. 11, 2011, the contents of which are hereby incorporated by reference.

BACKGROUND

1. Field

The present disclosure relates to a sheet feeding device used for an image forming apparatus such as a copier, a printer, a facsimile, or a multifunction peripheral thereof, and for the image forming apparatus including the same. In particular, the present disclosure relates to the sheet feeding device including a sheet feed cassette and a manual bypass tray, and the image forming apparatus including the same.

2. Description of Related Art

In the image forming apparatus, a sheet is transported to an image forming portion. After transferring a toner image formed on an image carrier in the image forming portion onto the sheet, a process of fixing the toner image onto the sheet is performed so as to form the image. As a method of transporting the sheet to the image forming portion, there are two methods. One is a cassette feeding method in which a plurality of sheets are stacked in a sheet feed cassette in advance, and the sheets are picked up one by one from the sheet feed cassette and are sent out to the image forming portion. The other is a manual bypass feeding method in which the sheet is set onto a manual bypass tray and is sent to the image forming portion. The image forming apparatus includes both the sheet feed cassette and the manual bypass tray. Sheets of a size used frequently for printing are stacked in the sheet feed cassette, while an envelope, a special sheet such as thick paper, or a sheet of a size that is not stacked in the sheet feed cassette is set onto the manual bypass tray. Then, one of the methods is selected so that the sheet is sent out.

Usually, a cassette feed roller is used for sending out the paper from the sheet feed cassette to the image forming portion, and a manual bypass roller is used for sending out the paper from the manual bypass tray. In addition, there is known a technique of using the same feed roller for sending out both the sheet from the sheet feed cassette and the sheet from the manual bypass tray to the image forming portion.

As to the above-mentioned technique, in a sheet feeding device of a first related technique, the sheet feed cassette and the manual bypass tray are disposed in a vertically stacked manner. The feed roller is disposed on the sheet feed cassette in a pivotable manner, and an upper slide plate and a lower slide plate are disposed on the manual bypass tray in a slidable manner in a direction of sending out the sheet. In a state where the feed roller contacts with the sheet feed cassette, the sheet stacked in the sheet feed cassette can be sent out. On the other hand, when the sheet on the manual bypass tray is sent out, the upper slide plate is made to slide. Then, the lower slide plate moves to slide toward the feed roller so that the feed roller is lifted up toward the upper face of the lower slide plate. Thus, the sheet set on the manual bypass tray can be sent out by the feed roller.

However, the sheet feeding device of the first related technique needs a mechanism for driving the feed roller to rock, and it is necessary to dispose the upper slide plate and the lower slide plate sliding in the direction of sending out the sheet. Therefore, there is a disadvantage that a structure of the apparatus becomes complicated.

SUMMARY

It is an object of the present disclosure to provide a sheet feeding device and an image forming apparatus including the same, in which double feeding of sheets in the sheet feed cassette is prevented by using a single feed roller, and an envelope or a cardboard sheet on the manual bypass tray can be securely sent out, with a simple structure.

A sheet feeding device according to an aspect of the present disclosure includes a sheet storing portion in which a sheet stacking member capable of moving vertically with stacked sheets is disposed, a nip portion formed by a feed roller and a separation member pressed to the feed roller, a sheet guide portion disposed upstream of the nip portion so as to guide a leading edge of a sheet sent from the sheet storing portion to the nip portion, a manual bypass sheet feeder disposed above the sheet storing portion so as to enable a sheet to be fed manually, and a manual bypass guide member which extends from the manual bypass sheet feeder so that a tip portion thereof is disposed between the sheet guide portion and the nip portion, and is capable of being deformed vertically so as to guide a manual bypass sheet toward the nip portion. As to the sheets in the sheet storing portion, only an uppermost sheet among a plurality of sheets stacked on the sheet stacking member is separated by the nip portion and is sent out by the feed roller to a sheet transport path. A sheet on the manual bypass sheet feeder is guided by the manual bypass guide member toward the nip portion and is sent out by the feed roller to the sheet transport path.

Further features and advantages of the present disclosure will become more apparent from the description of embodiments given below.

Other objects of the present disclosure and specific advantages obtained by the present disclosure will become apparent from the description of embodiments given below.

DETAILED DESCRIPTION

Hereinafter, an embodiment of the present disclosure is described with reference to the drawings, but the present disclosure is not limited to this embodiment. In addition, applications of the disclosure and terms described here should not be interpreted as a limitation.

Figure 1:
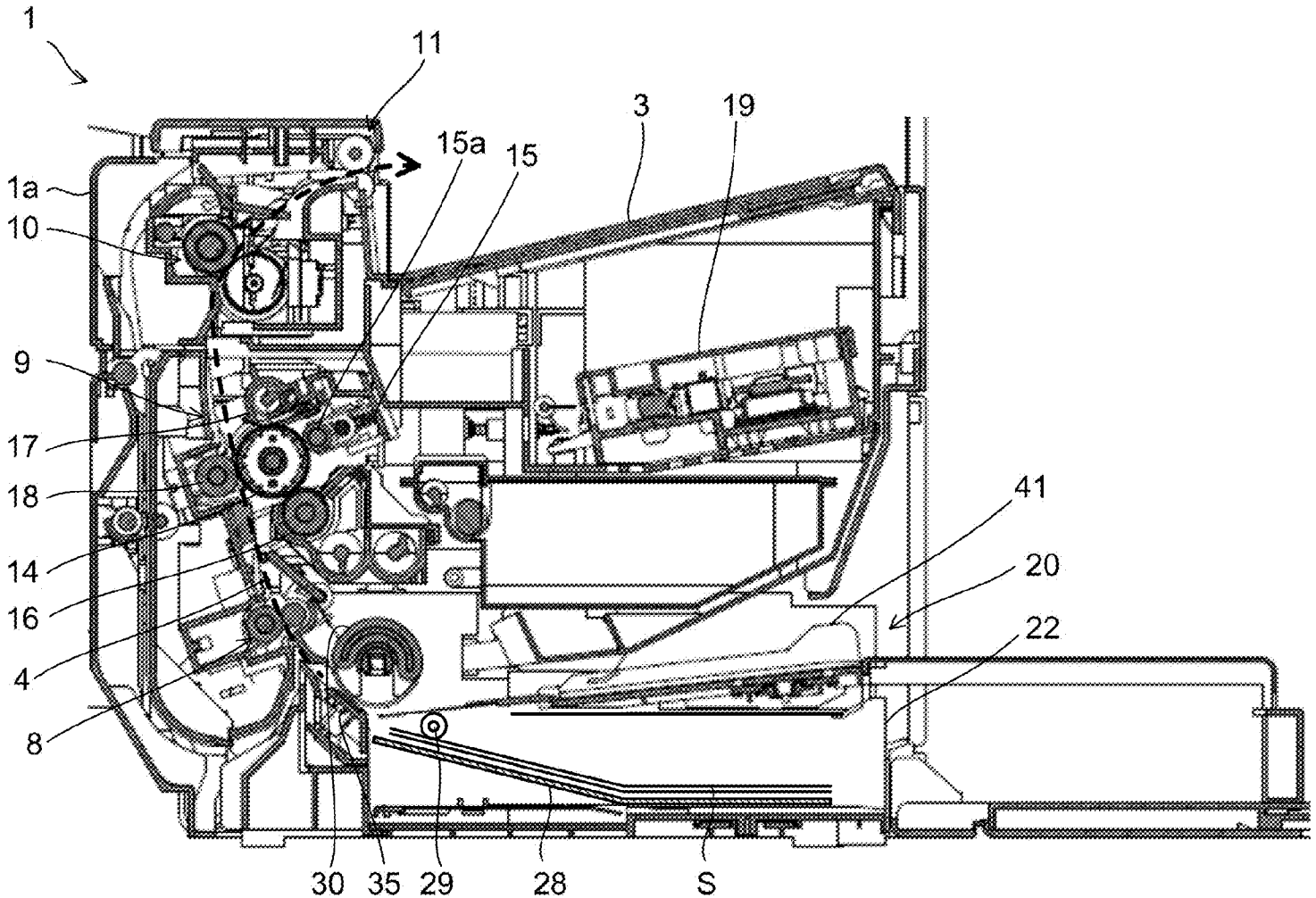
FIG. 1 is a cross-sectional view illustrating an image forming apparatus including a sheet feeding device according to an embodiment of the present disclosure.

FIG. 1 is a cross-sectional view illustrating a whole structure of an image forming apparatus including a sheet feeding device according to the embodiment of the present disclosure, in which the right side is a front side of the image forming apparatus. A sheet feeding device 20 is disposed in a lower part of an apparatus body 1*a* of an image forming apparatus 1. The sheet feeding device 20 includes a sheet feed cassette 22 as a sheet storing portion for storing stacked sheets S and a manual bypass tray 41 as a manual bypass sheet feeder. The sheet feed cassette 22 is disposed in a manner capable of being drawn out of the front of the apparatus body 1*a* for storing the sheets S. The manual bypass tray 41 is disposed above the sheet feed cassette 22. Note that the sheet feed cassette 22 may be fixed to the apparatus body 1*a*. On the rear side of the sheet feeding device 20, there is disposed a sheet transport path 4 extending upward from the lower part of the apparatus body 1*a* so as to reach a sheet delivery portion 3 formed on the upper face of the apparatus body 1*a*. Along this sheet transport path 4, in order from an upstream side in a sheet transport direction, there are disposed a pickup roller 29, a feed roller 30, a registration roller pair 8, an image forming portion 9, a fixing portion 10, and a delivery roller pair 11.

The sheet feed cassette 22 includes a sheet stacking plate 28 supported by the sheet feed cassette 22 in a pivotable manner. The sheets S stacked on the sheet stacking plate 28 are sent out by the pickup roller 29 toward the sheet transport path 4. When a plurality of sheets S are sent out simultaneously by the pickup roller 29, the sheets S are separated by the feed roller 30 and a separation pad 35 so that only the uppermost sheet is sent out. The sheet S sent out to the sheet transport path 4 is transported to the registration roller pair 8, and is supplied to the image forming portion 9 at a timing adjusted by the registration roller pair 8.

The manual bypass tray 41 is used for sending out a sheet S such as a sheet of a size that is not stacked in the sheet feed cassette 22, an envelope, a cardboard sheet, or the like to the image forming portion 9 via the registration roller pair 8, and the sheet S is placed on the manual bypass tray 41 from the front of the apparatus body 1*a*.

The image forming portion 9 forms a predetermined toner image on the sheet S by an electrophotographic process. The image forming portion 9 is constituted of a photosensitive member 14 as an image carrier supported in a rotatable manner about an axis in a clockwise direction in FIG. 1, a charging device 15, a developing device 16, and a cleaning device 17, which are disposed around the photosensitive member 14, a transfer roller 18 disposed to be opposed to the photosensitive member 14 via the sheet transport path 4, and an exposing device 19 disposed in front of the photosensitive member 14.

The charging device 15 includes a conductive rubber roller 15*a* to which a power supply (not shown) is connected, and the conductive rubber roller 15*a* is disposed to contact with photosensitive member 14. Further, when the photosensitive member 14 rotates, the conductive rubber roller 15*a* contacts with the surface of the photosensitive member 14 and rotates to follow the same. In this case, a predetermined voltage is applied to the conductive rubber roller 15*a* so that the surface of the photosensitive member 14 is uniformly charged.

Next, an electrostatic latent image is formed on the photosensitive member 14 by a light beam emitted from the exposing device 19 based on input image data. Then, toner is adhered to the electrostatic latent image by the developing device 16 so that a toner image is formed on the surface of the photosensitive member 14. Then, the sheet S is supplied at a predetermined timing from the registration roller pair 8 to between the photosensitive member 14 and the transfer roller 18 (transfer position), and the toner image on the surface of the photosensitive member 14 is transferred onto the sheet S by the transfer roller 18.

Then the sheet S onto which the toner image is transferred is separated from the photosensitive member 14 and is transported toward the fixing portion 10. This fixing portion 10 is disposed downstream of the image forming portion 9 in the sheet transport direction. The sheet S onto which the toner image has been transferred in the image forming portion 9 is heated and pressed by a heat roller and a pressure roller of the fixing portion 10 so that the transferred toner image is fixed on the sheet S.

The sheet S after the image formation is delivered to the sheet delivery portion 3 by the delivery roller pair 11. On the other hand, toner remaining on the surface of the photosensitive member 14 after the transferring is removed by the cleaning device 17, and the photosensitive member 14 is charged again by the charging device 15. Thus the image formation is performed in the same manner.

Figure 2:
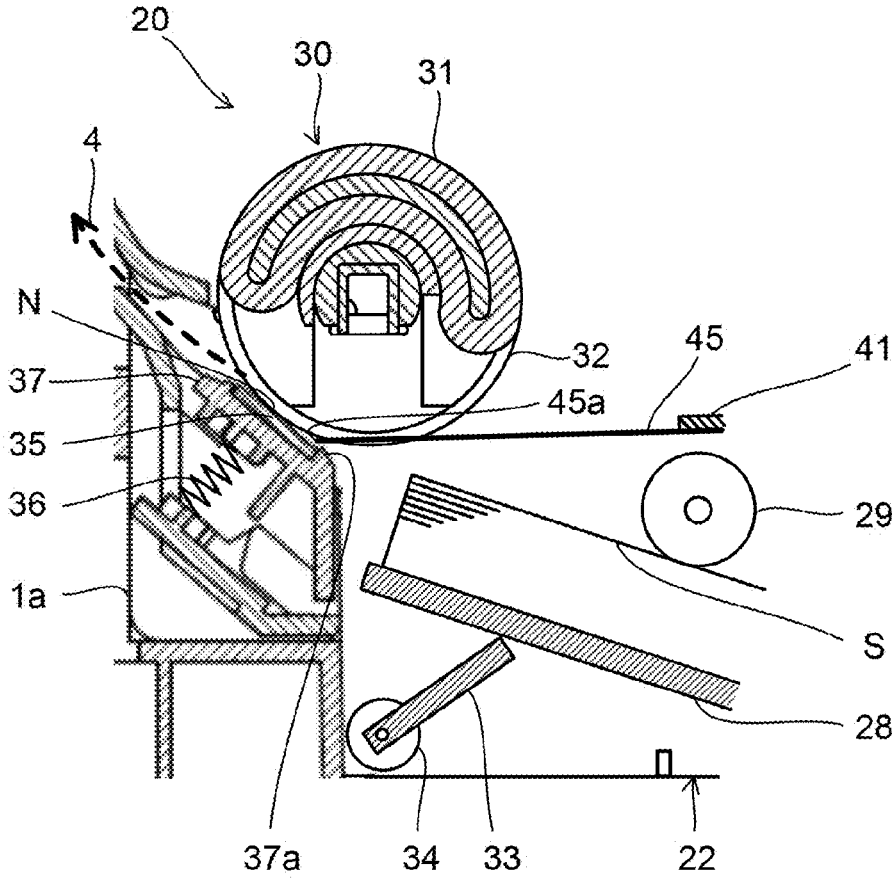
FIG. 2 is a cross-sectional view illustrating a main part of the sheet feeding device according to the embodiment of the present disclosure.
Figure 3:
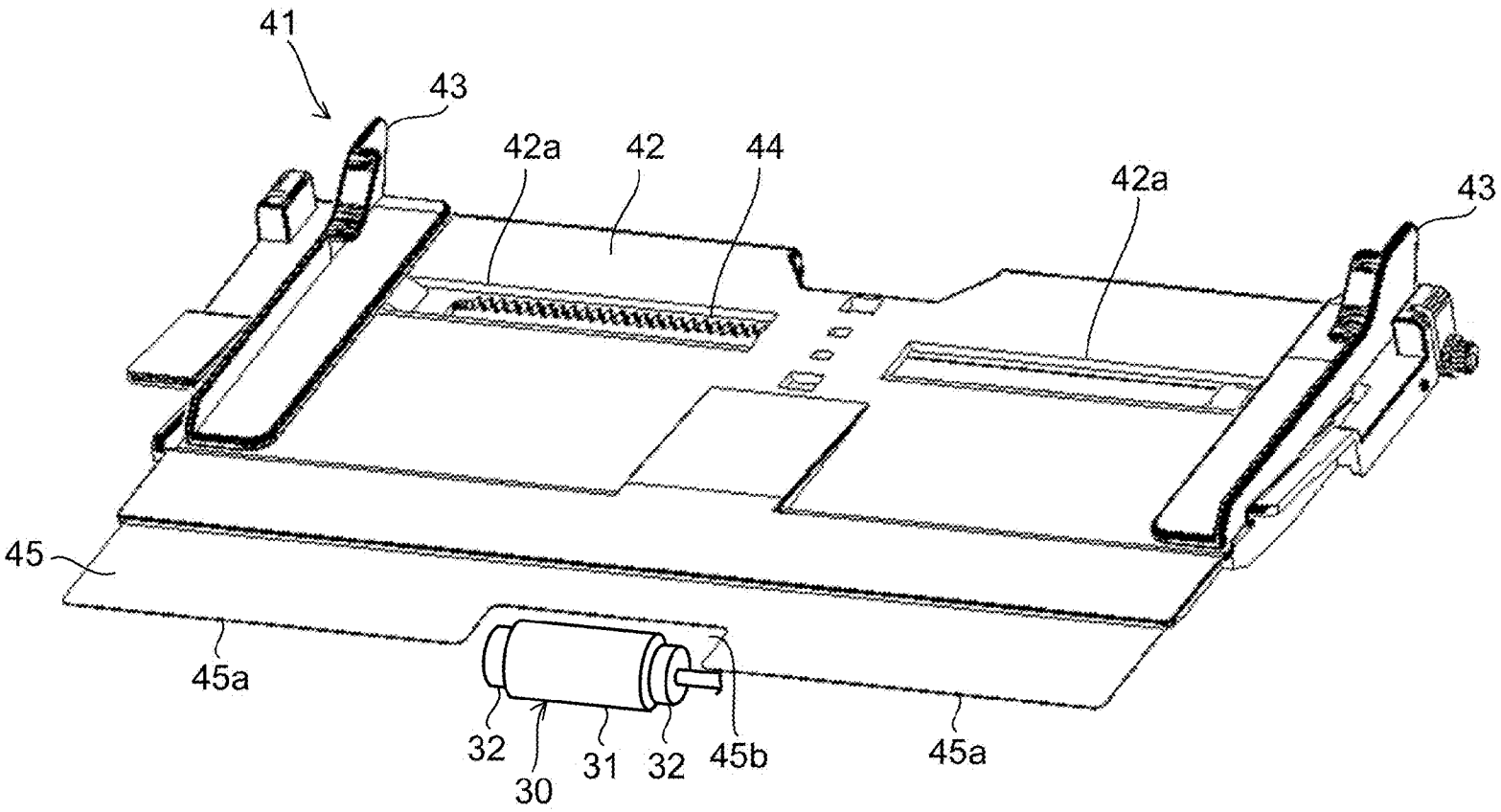
FIG. 3 is a perspective view illustrating a manual bypass sheet feeder of the sheet feeding device according to the embodiment of the present disclosure.
Figure 4:
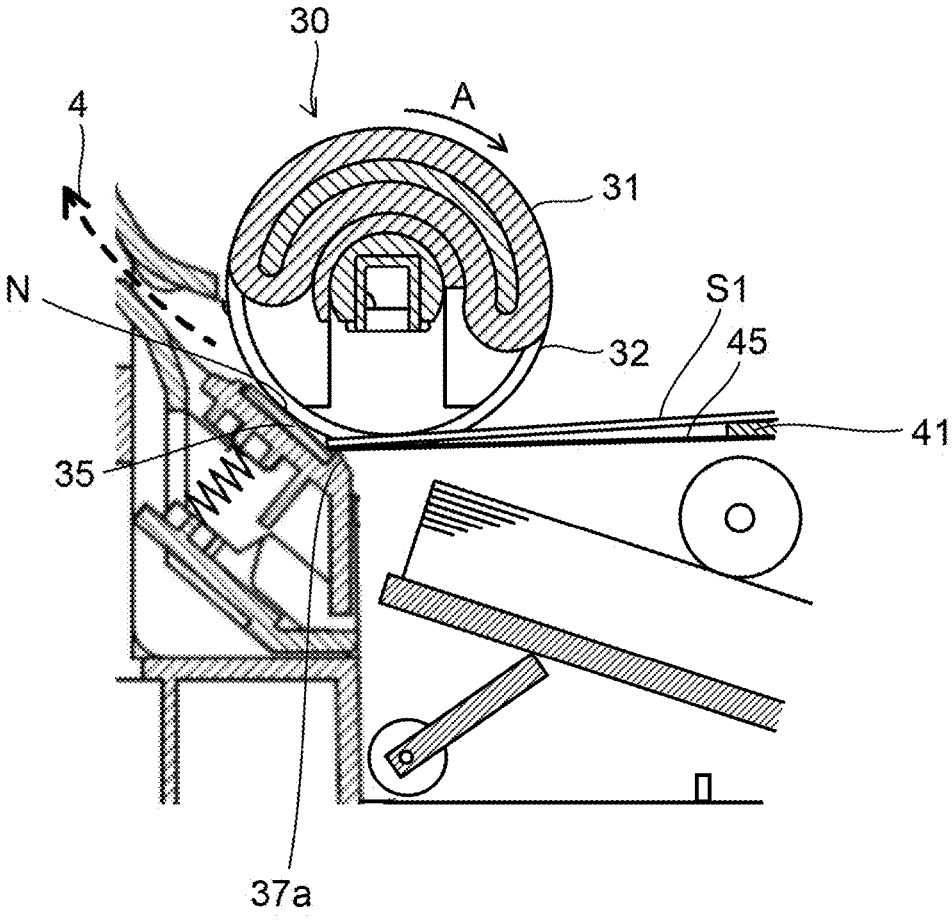
FIG. 4 is a cross-sectional view illustrating a case where a sheet is sent out from the manual bypass sheet feeder of the sheet feeding device according to the embodiment of the present disclosure.
Figure 5:
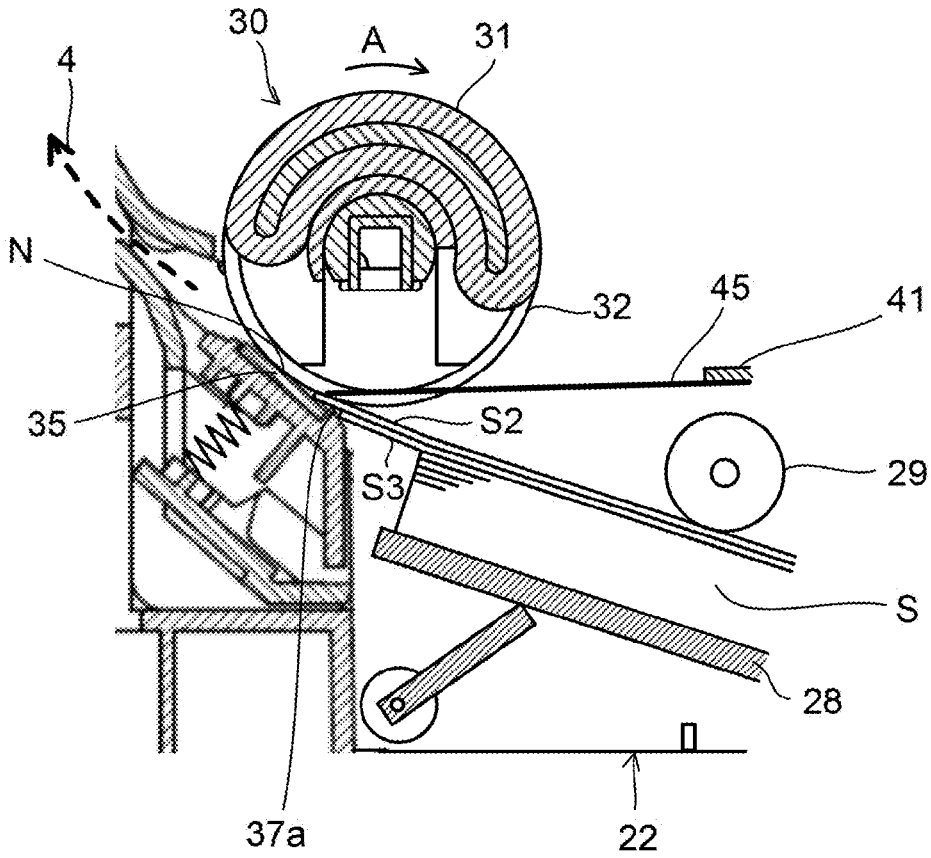
FIG. 5 is a cross-sectional view illustrating a case where a sheet is sent out from a sheet feed cassette of the sheet feeding device according to the embodiment of the present disclosure.

With reference to FIGS. 2 to 5, the sheet feeding device 20 is described in detail. FIG. 2 is a partial cross-sectional view illustrating the feed roller 30 and vicinity of the sheet feeding device 20, and FIG. 3 is a perspective view illustrating the manual bypass tray 41. FIG. 4 is a partial cross-sectional view of the feed roller 30 and vicinity illustrating a case where the sheet S is sent out from the manual bypass tray 41, and FIG. 5 is a partial cross-sectional view of the feed roller 30 and vicinity illustrating a case where the sheet S is sent out from the sheet feed cassette 22.

As illustrated in FIG. 2, the sheet feed cassette 22 includes the sheet stacking plate 28 as the sheet stacking member and a lift plate 33. The pickup roller 29, the feed roller 30, and the separation pad 35 as a separation member are disposed in the apparatus body 1*a*.

The sheet stacking plate 28 is disposed in the sheet feed cassette 22, and an upstream side thereof in a direction of sending out the sheet S is supported in a pivotable manner about a rotation axis (not shown). The sheets S are stacked on this sheet stacking plate 28.

The lift plate 33 is disposed below the sheet stacking plate 28 and is rotated by a gear 34. When the sheet feed cassette 22 is attached to the apparatus body 1*a*, the gear 34 is engaged with a drive gear (not shown) disposed on the apparatus body 1*a* side and is connected via the drive gear to an elevating motor (not shown) disposed in the apparatus body 1*a* and is driven by the same. When the elevating motor is driven to rotate in one direction, the lift plate 33 is gradually lifted up, and the sheet stacking plate 28 contacting with the tip of the lift plate 33 is lifted up. When the sheet stacking plate 28 is lifted up, the sheets S stacked on the sheet stacking plate 28 is pressed to the pickup roller 29. One or more sheets S of the uppermost of the sheets stacked on the sheet stacking plate 28 are sent by the pickup roller 29 to the feed roller 30 side. On the other hand, when the elevating motor is driven to rotate in the other direction, the lift plate 33 gradually moves down. Then, the sheet stacking plate 28 moves downward.

The feed roller 30 sends out the sheet S from the sheet feed cassette 22 or the sheet S placed on the manual bypass tray 41 to the sheet transport path 4. When a plurality of sheets S are sent out from the sheet feed cassette 22, the feed roller 30 separates only the uppermost sheet S from the plurality of sheets S together with the separation pad 35 so as to send the sheet S to the sheet transport path. The feed roller 30 includes a roller 31 and a pair of collars 32, and is supported by the apparatus body 1*a* in a rotatable manner in substantially the middle of the sheet S in a width direction (front and rear direction of a paper face of FIG. 2).

The roller 31 is formed of an elastic material such as rubber in a circular shape whose periphery is partially chipped, for example, in a semicircular shape. The collar 32 is formed of resin or the like having a smooth surface in a circular shape having an outer diameter smaller than the roller 31, and is disposed adjacent to each side of the roller 31 in the axis direction.

The separation pad 35 is disposed to be opposed to the feed roller 30. Therefore, the separation pad 35 is made of a plate material formed in a rectangular shape having substantially the same width as the length of the feed roller 30 in the axial direction. In addition, the surface opposed to the feed roller 30 is formed to be a frictional surface. The separation pad 35 is attached to a support member 37 with adhesive.

The support member 37 is forced toward the feed roller 30 by a forcing member 36 such as a helical spring and is retained by the apparatus body 1*a* in a movable manner toward the feed roller 30 side. When the feed roller 30 rotates so that the roller 31 is in a position opposed to the separation pad 35, the roller 31 contacts with the separation pad 35. Further, when the roller 31 is in a position that is not opposed to the separation pad 35 (in a state of FIG. 2), the collar 32 contacts with the separation pad 35. In this way, the support member 37 is retained. When the feed roller 30 rotates so that the roller 31 is in a position opposed to the separation pad 35 or that the collar 32 is in a position opposed to the separation pad 31, a predetermined nip pressure works in a nip portion N.

Therefore, when the feed roller 30 rotates to send out the sheet S, the nip pressure works in the nip portion N so that the sheet S is sent out by the roller 31 to the sheet transport path 4. After the sheet S is sent out, the roller 31 stops at a position that is not opposed to the separation pad 35 (in the state of FIG. 2), and the feed roller 30 becomes ready for sending out a next sheet S.

A sheet guide portion 37*a* is formed in the support member 37. The sheet guide portion 37*a* is formed in an inclined surface shape on the upstream side of the nip portion N so as to guide the leading edge of the sheet S sent from the sheet feed cassette 22 to the nip portion N. Specifically, the sheets S stacked on the sheet stacking plate 28 are sent to the sheet guide portion 37*a* to have a predetermined angle of inclination, and the inclined surface of the sheet guide portion 37*a* is set to have an angle larger than the angle of inclination of the sheet S. In addition, the inclined surface of the sheet guide portion 37*a* is set to have an angle large than an angle of inclination of the separation pad 35. Thus, the leading edge of the sheet S sent from the sheet feed cassette 22 contacts with the sheet guide portion 37*a* and enters the nip portion N smoothly along the sheet guide portion 37*a*. In addition, when a plurality of sheets S are sent from the sheet feed cassette 22, the uppermost sheet S among the plurality of sheets S moves first toward the nip portion N along the inclined surface of the sheet guide portion 37*a*, and hence simultaneous sending of the plurality of sheets S to the nip portion N is prevented.

The manual bypass tray 41 is disposed above the sheet feed cassette 22.

As illustrated in FIG. 3, the manual bypass tray 41 includes a tray body 42 on which the sheet S can be placed, a pair of cursors 43 disposed on the upper surface of the tray body 42 so as to be adjusted to a width of the sheet S for positioning the sheet S, and a manual bypass guide member 45 for guiding the placed sheet S toward the nip portion N of the feed roller 30.

The tray body 42 includes a pair of openings 42*a* and the pair of cursors 43. The pair of cursors 43 includes racks 44 that are formed downward from individual lower rim portions thereof and extend in the width direction. The pair of openings 42*a* extends in the width direction in the tray body 42 and is notched. Each of the racks 44 is disposed on the backside of the tray body 42 via each opening 42*a*. Further, these racks 44 have surfaces with teeth facing opposite to each other (not shown) so as to engage with a pinion. Thus, one of the cursors 43 is moved, the other cursor 43 is moved to the opposite direction to the one cursor 43 by the same movement so that the sheet S is positioned in accordance with the width of the sheet S.

This embodiment has a structure in which the manual bypass tray 41 is disposed above the sheet feed cassette 22, and the sheet S in the sheet feed cassette 22 (see FIG. 2) and the sheet S on the manual bypass tray 41 are sent out by the same feed roller 30 to the sheet transport path 4. In this structure, when the sheet S is placed on the manual bypass tray 41, the leading edge of the sheet S inserted into the manual bypass tray 41 contacts with the sheet guide portion 37*a* (see FIG. 2), and the sheet S may be hardly sent to the nip portion N (see FIG. 2). Specifically, the inclined surface of the sheet guide portion 37*a* (see FIG. 2) is disposed to be opposed by a predetermined angle to a surface of the manual bypass tray 41 on which the sheet S is placed. Further, the predetermined angle becomes larger in a structure in which the surface of the manual bypass tray 41 on which the sheet S is placed is inclined downward on the downstream side in the direction of sending out the sheet S in order that the sheet S can be easily sent from the manual bypass tray 41 toward the feed roller 30. When an angle between the inclined surface of the sheet guide portion 37*a* and the surface on which the sheet S is placed becomes large, the leading edge of the sheet S inserted in the manual bypass tray 41 abuts the sheet guide portion 37*a* so that the sheet S can be hardly sent to the nip portion N (see FIG. 2). In particular, when the sheet S is a hard and strong sheet such as cardboard, a feed error of the sheet to the nip portion N often occurs.

Therefore, the manual bypass guide member 45 is disposed to extend from the manual bypass tray 41 toward the feed roller 30. The manual bypass guide member 45 is attached to a lower surface of a leading edge of the tray body 42 of the manual bypass tray 41 (on the feed roller 30 side) with adhesive and is formed of polyethylene terephthalate resin or the like in a sheet-like shape having elastic property. In addition, the manual bypass guide member 45 has substantially the same length as a width of the tray body 42 and is formed to have a leading edge 45*a* extending in the direction of sending out the sheet to between the sheet guide portion 37*a* of the support member 37 and the nip portion N (see FIG. 2). With this structure, the feed error of the sheet S to the nip portion N can be prevented. Note that the leading edge 45*a* of the manual bypass guide member 45 may be disposed to extend to a vicinity of the nip portion N as long as being disposed on the downstream side of the sheet guide portion 37*a*.

Further, in order that the sheet S in the sheet feed cassette 22 and the sheet S on the manual bypass tray 41 can be fed by the single feed roller 30, a notch portion 45*b* having a U shape in a plan view that is a little larger than the feed roller 30 or the separation pad 35 is formed in a leading edge 45*a* of the manual bypass guide member 45.

With the above-mentioned structure of the manual bypass guide member 45 and the notch portion 45*b* disposed in the position opposed to the feed roller 30 and the separation pad 35, as illustrated in FIG. 4, when a sheet S1 is placed on the manual bypass tray 41, the sheet S1 can be securely fed to the nip portion N.

Specifically, the leading edge of the sheet S1 inserted in the manual bypass tray 41 is guided toward the feed roller 30 by the manual bypass guide member 45, and the sheet S1 contacts with the surface of the collar 32 of the feed roller 30. Then, the manual bypass guide member 45 is deformed downward in accordance with a thickness of the sheet S1. Even if the sheet S1 contacts with the surface of the collar 32, because the surface of the collar 32 is smooth, the sheet S1 can be guided to a vicinity of the nip portion N.

When the feed roller 30 is driven to rotate in a direction of arrow A in the state where the sheet S1 is placed on the manual bypass tray 41 as described above, the roller 31 contacts with a surface of the sheet S1, and the sheet S1 is sandwiched between the roller 31 and the separation pad 35 so as to be sent to the nip portion N. The sheet S1 sent to the nip portion N is securely sent out by the roller 31 to the sheet transport path 4. In addition, when the sheet S is fed from the manual bypass tray 41 in the state where the sheet S is placed in the sheet feed cassette 22, the sheet S in the sheet feed cassette 22 may be transported to the nip N by friction of the back surface of the sheet S fed from the manual bypass tray 41. In this case, too, when the sheet S is fed again from the manual bypass tray 41, the roller 31 of the feed roller 30 contacts with the sheet S from the manual bypass tray 41 first. Therefore, the sheet S is not fed from the sheet feed cassette 22.

As illustrated in FIG. 5, when the sheet S is sent out from the sheet feed cassette 22 to the sheet transport path 4, the pickup roller 29 is driven to rotate so that the sheets S stacked on the sheet stacking plate 28 are transported toward the feed roller 30. In this case, when a plurality of sheets S2 and S3 are transported toward the feed roller 30, the uppermost sheet S2 moves first along the inclined surface of the sheet guide portion 37*a* toward the nip portion N. Therefore, simultaneous feeding of the sheets S2 and S3 to the nip portion N is prevented.

However, when the plurality of sheets S2 and S3 are sent to the nip portion N simultaneously, the feed roller 30 rotates in the direction of arrow A, and a predetermined nip pressure works in the nip portion N by the roller 31 against the separation pad 35. Then, the sheets S2 and S3 are separated so that only the sheet S2 is sent out to the sheet transport path 4.

Here, when the sheet S is transported from the sheet feed cassette 22 to the feed roller 30, the sheet S contacts with the lower surface of the manual bypass guide member 45. Because the manual bypass guide member 45 has an elastic property in the up and down direction, the sheet S lifts up the manual bypass guide member 45 against an elastic force of the manual bypass guide member 45 and is securely sent to the nip portion N.

With a simple structure in which the manual bypass guide member 45 is disposed in a predetermined position, the sheet S on the sheet feed cassette 22 is sent out without overlapping by the single feed roller 30 to the sheet transport path 4. In addition, the sheet S such as an envelope or a cardboard sheet on the manual bypass tray 41 can be securely sent out to the sheet transport path 4.

Note that the embodiment describes the structure in which when a plurality of sheets S are simultaneously sent to the feed roller 30, the feed roller 30 and the separation pad 35 separate the sheets S. However, the present disclosure is not limited to this structure. It is possible to adopt a structure in which the sheets S are separated by a feed roller having a complete outer surface formed in a cylindrical shape and a separation roller having a torque limiter. In this case too, the same effect as the above-mentioned embodiment can be obtained.

In addition, the above-mentioned embodiment describes the case where the manual bypass guide member 45 is attached to the manual bypass tray 41 with adhesive or the like. But, the present disclosure is not limited to this structure. It is possible to adopt a structure in which the manual bypass guide member 45 is attached to the apparatus body 1*a*, and the leading edge 45*a* of the manual bypass guide member 45 is disposed on the downstream side of the sheet guide portion 37*a*. In this case too, the same effect as the above-mentioned embodiment can be obtained.

In addition, the embodiment describes the structure in which the sheet stacking plate 28 of the sheet feed cassette 22 moves up and down by the elevating motor via the lift plate 33, and the pickup roller 29 sends the sheets S stacked on the sheet stacking plate 28 toward the feed roller 30. However, the present disclosure is not limited to this structure. It is possible to adopt a structure in which the sheet stacking plate 28 is forced upward by a spring, and a cam is fixed to the feed roller 30, so that the sheet stacking plate 28 is moved up and down by rotation of the cam and a force of the spring. Specifically, when the roller 31 of the feed roller 30 is positioned in the upper part (see FIG. 2), the sheet stacking plate 28 is positioned in the lower part. When the feed roller 30 rotates from this state so that the roller 31 is opposed to the separation pad 35, the sheet stacking plate 28 moves upward by the spring. When the sheet stacking plate 28 moves upward, the uppermost sheet S of the stacked sheets in the sheet stacking plate 28 is pressed to the roller 31 of the feed roller 30, and the uppermost sheet S is sent out by rotation of the roller 31. When no sheet S is sent out from the sheet feed cassette 22, the sheet stacking plate 28 is in a position below the sheet feed cassette 22, the sheet S can be easily inserted from the manual bypass tray 41. In addition, because the roller 31 of the feed roller 30 also has a function of the pickup roller 29 that abuts the sheet S to send out the same, the sheet feed cassette 22 can have a simple structure and can be downsized.

The present disclosure can be used for a sheet feeding device used for an image forming apparatus such as a copier, a printer, a facsimile, or a multifunction peripheral thereof, and for the image forming apparatus including the same. In particular, the present disclosure can be used for the sheet feeding device including a sheet feed cassette and a manual bypass tray, and the image forming apparatus including the same.

What is claimed is:

1. A sheet feeding device comprising:

a sheet storing portion including a sheet stacking member that stores sheets and is capable of moving up and down;

a nip portion formed by a feed roller and a separation member pressed to the feed roller;

a sheet guide portion disposed upstream of the nip portion so as to guide a leading edge of a sheet sent from the sheet storing portion to the nip portion;

a manual bypass sheet feeder disposed above the sheet storing portion for enabling to feed a manual bypass sheet; and a manual bypass guide member extending from the manual bypass sheet feeder, which has a leading edge disposed between the sheet guide portion and the nip portion, and is capable of being elastically deformed in up and down direction so as to guide the manual bypass sheet toward the nip portion, wherein as to the sheets in the sheet storing portion, only an uppermost sheet is separated by the nip portion from a plurality of sheets stacked in the sheet stacking member and is sent out by the feed roller to the sheet transport path, a sheet on the manual bypass sheet feeder is guided by the manual bypass guide member to the nip portion and is sent out by the feed roller to the sheet transport path, and when a sheet on the manual bypass sheet feeder is guided by the manual bypass guide member toward the nip portion, a leading edge of the manual bypass guide member is held between the sheet guide portion and the nip portion in a sheet transport direction.

2. The sheet feeding device according to claim 1, wherein a leading edge portion of the manual bypass guide member is disposed downstream of an upstream edge portion of the separation member.

3. The sheet feeding device according to claim 1, wherein the manual bypass guide member is made of a sheet material having a rectangular shape attached to the manual bypass sheet feeder, and a notch portion having a U shape in a plan view larger than a length of the feed roller in the axial direction is formed in the leading edge portion of the manual bypass guide member at a position opposed to the feed roller.

4. The sheet feeding device according to claim 1, wherein the feed roller includes roller that is formed in a circular shape whose periphery is partially chipped and is capable of being pressed to contact with the separation member, and a collar having a circular shape smaller than an outer diameter of the roller and is disposed on each side of the roller in the axial direction.

5. The sheet feeding device according to claim 4, wherein the collar has a smooth outer circumference surface, and the manual bypass sheet guided by the manual bypass guide member contacts with the outer circumference surface of the collar.

6. The sheet feeding device according to claim 5, wherein when the feed roller is driven to rotate, the roller sends the manual bypass sheet to the nip portion.

7. The sheet feeding device according to claim 1, wherein the separation member is made of a sheet material forced toward the feed roller by a forcing member and is attached to a support member forming the sheet guide portion.

8. An image forming apparatus comprising a sheet feeding device according to claim 1, and an image forming portion for forming an image on a sheet transported from the sheet feeding device.

* * * * *